United States Patent [19]

Tibbitts

[11] Patent Number: 4,877,096

[45] Date of Patent: Oct. 31, 1989

[54] REPLACEABLE CUTTER USING INTERNAL DUCTILE METAL RECEPTACLES

[75] Inventor: Gordon A. Tibbitts, Salt Lake City, Utah

[73] Assignee: Eastman Christensen Company, Salt Lake City, Utah

[21] Appl. No.: 336,643

[22] Filed: Apr. 7, 1989

Related U.S. Application Data

[63] Continuation of Ser. No. 121,471, Nov. 17, 1987, abandoned.

[51] Int. Cl.[4] ..... E21B 10/46; E21B 10/62

[52] U.S. Cl. ..... 175/410; 175/329

[58] Field of Search ..... 175/329, 330, 410, 409, 175/374; 407/102, 118, 119

[56] References Cited

U.S. PATENT DOCUMENTS

| | | | |
|---|---|---|---|
| 4,199,035 | 4/1980 | Thompson | 175/410 |
| 4,200,159 | 4/1980 | Peschel et al. | 175/329 |
| 4,351,401 | 9/1982 | Fielder | 175/329 |

FOREIGN PATENT DOCUMENTS

| | | | |
|---|---|---|---|
| 2056381 | 5/1972 | Fed. Rep. of Germany | 175/410 |
| 2115460 | 9/1983 | United Kingdom | 175/329 |

*Primary Examiner*—Hoang C. Dang

*Attorney, Agent, or Firm*—J. A. Walkowski; M. L. Lynch

[57] ABSTRACT

A replaceable stud cutter for use in matrix drag bit is provided by furnacing a ductile metallic receptacle within the body of the drag bit as it is fabricated. The metal receptacle is characterized by having a receiving cavity defined therein and by including various mechanisms such as grooves or flares which facilitate retention of the metallic receptacle within the matrix body. The lowermost portion of the receptacle within the matrix body may also be shaped or tapered to allow dense packing of the receptacle adjacent to other receptacles along a given radial line on the bit face. A replaceable cutter is brazed, adhesively bonded and/or mechanically locked within the receiving cavity defined in the metal receptacle. When the replaceable cutter becomes worn through normal use, the mechanical locking elements can be drilled out, the brazing melted or adhesive dissolved to allow insertion of a new replacement cutter without causing any damage or alteration either to the receptacle, matrix body or bit face.

12 Claims, 1 Drawing Sheet

REPLACEABLE CUTTER USING INTERNAL DUCTILE METAL RECEPTACLES

This application is a continuation division of application Ser. No. 07/121,471, filed Nov. 17, 1987, now abandoned.

BACKGROUND OF THE INVENTION

1. Field of the Invention

The invention relates generally to the field of earth boring tools and in particular to stud mounted diamond cutters in drag bits.

2. Description of the Prior Art

The prior art has devised many different designs for mounting large thermally nonstable diamond tables in matrix metal drag bits. Generally, these designs can be classified either as slug cutters or stud cutters. A slug cutter comprises a slug, usually a cylinder, comprised in turn of two or more component slugs and bonded together by various means. The slug is then brazed into a mating cylindrical cavity molded into the bit face of a matrix bit according to the design of the bit. A stud cutter is a one- or multiple-piece stud having a facing diamond table bonded in some manner to a shaped steel or metallic stud which is then force-fit or brazed into a cylindrical or conical cavity molded into the matrix bit or in the case of a steel body bit, simply machined into the body.

In either case, slug or stud mounted diamond cutters are permanently mounted to the bit body. When the cutters are worn, the end of the useful life of the bit body is also realized. Typically, if the diamond tables or stud cutters are to be retrieved for salvage, assuming that any salvage value exists, the bit body must be destroyed.

Although hydraulic wear of portions of the bit face can and do occur, the lifetime of a bit is generally determined by the lifetime of the cutters since it is the cutters which are positioned by the bit design for impact and abrasion with the rock formation as well as to hydraulic erosion. In a well designed bit, the bit body is usually subjected only to wear through hydraulic erosion. Furthermore, once the cutters are in place, the bit cannot be altered to change its performance characteristics.

Therefore, the lifetime and performance characteristics of a drag bit, and hence its value and utility could be substantially increased if some means were devised whereby a bit body could be repeatedly used for a period longer than the lifetime of the cutters or if the cutter configuration could be changed in the field. However, if this is to be accomplished by incorporating a replaceable or renewable cutter, the means which allow for replacement must be simple enough to allow convenient replacement without substantial sacrifice of bit and cutter impact resistance or cutter retention on the bit.

BRIEF SUMMARY OF THE INVENTION

The present invention is an improvement in a drag bit having a body comprising a receptacle permanently disposed within the body. The receptacle has a receiving cavity defined therein. A replaceable cutter is disposed at least in part within the receiving cavity and is temporarily secured therein. The replaceable cutter when worn is removable without destruction of the bit body and is replaceable by an unworn cutter element. The receptacle is composed of a ductile metal, such as steel. The replaceable cutter comprises a body portion, and a diamond cutting surface affixed to the body portion. The body portion is affixed at least in part within the receiving cavity. In the preferred embodiment, the receiving cavity is generally conical and the replaceable cutter element has at least a rearward portion with a corresponding mating conical shape. The replaceable cutter is immobilized within the receiving cavity by a locking pin. The replaceable cutter is affixed within the receiving cavity by brazing. The present invention thus enhances the ductility of teh cutter assembly, as well as the brazeability of the cutter to the bit, via the use of the aforesaid ductile metal receptacle.

The replaceable cutter could alternatively be affixed within the receiving cavity by an adhesive. The receptacle may be shaped to include a tapered root. The tapered root is disposed most deeply within the bit body as compared to other portions of the receptacle so that a plurality of the receptacles may be densely disposed in a highly curved bit body.

The tapered root includes a mechanism for mechanically locking the receptacle within the bit body. The mechanism for locking the receptacle withinthe bit body includes at least one generally horizontal groove defined within the surface of the tapered root. Additionally or alternatively thereto, the mechanism for locking the receptacle within the bit body comprises a flared end portion on the root disposed in the bit body.

A plurality of receptacles and correponding replaceable cutters are associated in that the receptacles are shaped according to at least two distinct geometrical patterns. At least two of the receptacles are shaped to be disposable within the bit body in a mutually interleaved configuration with at least a portion of one receptacle in front of the other while leaving the corresponding replaceable cutter elements of the two receptacles disposed on the same radius of the bit body.

The invention can also be characterized as a stud cutter assembly for use within a drag bit having a bit face and bit body comprising a ductile metallic receptacle for disposition and retention within the bit body. The receptacle includes a receiving cavity defined therein. A replaceable cutter is temporarily disposed and secured within the receiving cavity. The cutter provides a cutting surface extending above the bit face of the bit body. The replaceable cutter is removable and replaced by a second cutter without alteration of the bit body and receptacle.

The invention is still further characterized as a cutting assembly disposed within a bit body of a drag bit and extending beyond the bit face of the bit comprising a first element disposed within the bit body during formation of the bit body. The first element provides an attachment situs for a second element which provides a cutting surface for the bit body extending above the bit face. The second element is temporarily attached to the first element. The second element is removable from and replaceable within the first element.

The second element is arranged and configured so that substantially only compressive stress is exerted between the first and second element when the cutting assembly is used in the normal cutting operation of the bit.

The various embodiments of the invention are better visualized by turning to the following drawings wherein like elements are referenced by like numerals.

BRIEF DESCRIPTION OF THE DRAWINGS

FIG. 6 is a front elevational view of an alternative embodiment of two cutters shown in isolation of the surrounding bit material.

The invention may be better understood by now turning to the following detailed description.

DETAILED DESCRIPTION OF THE PREFERRED EMBODIMENTS

A replaceable stud cutter for use in matrix drag bit is provided by furnacing a ductile metallic receptacle within the body of the drag bit as it is fabricated. The metal receptacle is characterized by having a receiving cavity defined therein and by preferably including various mechanisms such as grooves or flares which facilitate retention of the metallic receptacle within the matrix body. The lowermost portion of the receptacle within the matrix body may also shaped or tapered to allow dense packing of the receptacle adjacent to other receptacles along a given radial line on the bit face. A replaceable cutter is brazed, adhesively bonded and/or mechanically locked within the receiving cavity defined in the metal receptacle. When the replaceable cutter becomes worn through normal use, the mechanical locking elements can be drilled out, the brazing melted or adhesive dissolved to allow insertion of a new replacement cutter without causing any damage or alteration either to the receptacle, matrix body or bit face.

Figure 1:
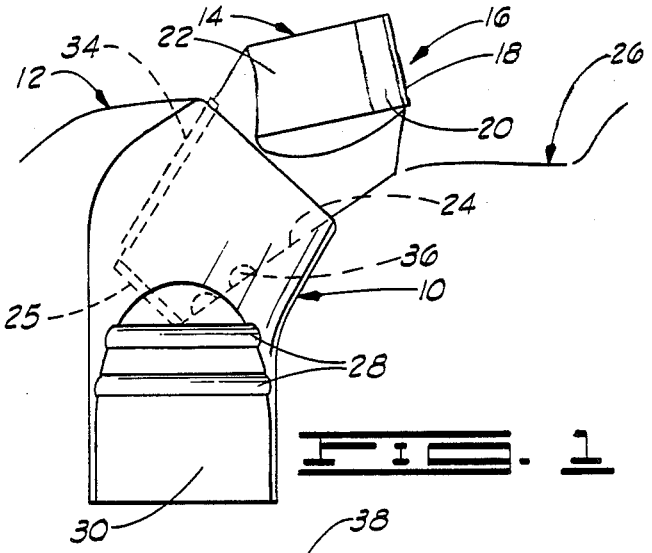
FIG. 1 is a side cross-sectional view of a cutter and a metal receptacle disposed in a matrix bit according to the invention.

FIG. 1 is side sectional view of a replaceable cutter together with an internal ductile metal receptacle shown in place within a matrix drag bit. A ductile metal receptacle, generally denoted by reference numeral 10, is molded in place within a matrix bit, generally denoted by reference numeral 12. Bit 12 is formed by conventional powdered matrix metal techniques. A replaceable cutter, generally denoted by reference numeral 14, is fixed or secured within receptacle 10 and bears on a portion positioned for exposure to the rock formation, a cutting element generally denoted by reference numeral 16. In the illustrated embodiment, replaceable cutter 14 is a metallic plug having an exposed diamond table 18 on a forwardly disposed face 20. Diamond table 18 is bonded by conventional means to a backing slug 22 which in turn is mechanically and/or metallurgically bonded into the body of cutter 14. In the preferred embodiment the rear portion of cutter 14 is provided with a generally conical shape which is disposed into a corresponding conically shaped cavity 24 defined in metal receptacle 10. Of course it will be understood by those of ordinary skill in the art that other cutter/cavity configurations are possible. For example, a cylindrical, triangular, or hexagonal cutter might be mated into a like-shaped cavity, or into one of a different shape to provide additional channels for braze or adhesive material, or mechanical locking means.

In the illustrated embodiment as shown in FIG. 1, metal receptacle 10is completely embedded beneath the bit face of bit 12 during the fabrication process of the bit face and is disposed so that when replaceable cutter 16 is fixed within conical cavity 24, diamond table 18 is properly disposed adjacent to a waterway 26 above the bit face. However, the placement of metal receptacle 10 relative to various features or element included within the design of the bit 12 is largely irrelevant to the invention as long as metal receptacle 10 is in some manner securely fixed or attached to bit 12.

Full embedment is illustrated, since this not only provides nearly integral and faultless retention of metal receptacle 10 within bit 12, but also serves to provide a high degree of impact resistance to receptacle 10. Retention of metal receptacle 10 is facilitated by the definition of one or more horizontal grooves 28 defined in root 30 of receptacle 10 which are filled in by the metallic matrix during molding.

Figure 2:
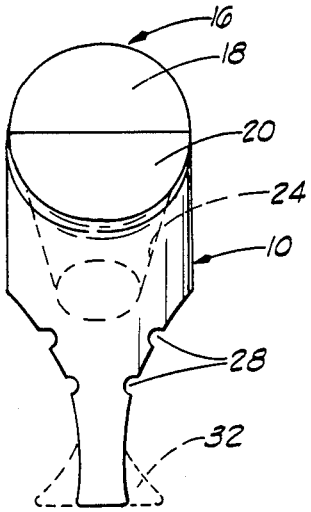
FIG. 2 is a front elevational view of the metal receptacle and cutter of FIG. 1 shown in isolation without the remaining portions of the bit.

In an alternative embodiment, as best illustrated in the front elevation view of FIG. 2, root 30 of receptacle 10 may also be provided with a bilateral flare 32 which serves to positively lock receptacle 10 within the body of bit 12.

It is also contemplated that a combination of grooves with flares may be employed, or that knurled or packed surfaces or multiple, smaller flares may be utilized as retention means.

Cutter 16 is secured within cavity 24 within ductile metal receptacle 10 by brazing, adhesive bonding, mechanical locking or any other means now known or later devised. In most applications the degree of the bonding strength between cutter 16 and receptacle 10 may be somewhat relaxed inasmuch as most of the stress placed upon replaceable cutter 16 is compressive. In the illustrated embodiment, cutter 16 is mechanically locked into place into cavity 24 by means of a locking pin 34 as illustrated in side view in FIG. 1, which is disposed partly in a longitudinal groove running along at least a part of the outside conical surface of the lower portion of cutter 16 and partly in a corresponding and mating longitudinal groove 38 defined within cavity 24 in receptacle 10. Locking pin 34 thus serves to prevent rotational movement of cutter 16 within receptacle 10. Transversely oriented locking pins or key fingers may also be employed to orient cutter 16 and to aid in its retention within receptacle 10. Affixation may be further secured by brazing and by annular retention grooves 36 defined into the lower portion of the conical surface of cutter 16 to provide annular locking ribs from the brazing material. Whether mechanical locked in cavity 24 by pins or the like metallurgically bonded by brazing or the like, or adhesively bonded, cutter 16 is replaceable within bit 12 in the field.

The lower portion of cutter 16 does not bottom out against the bottom of cavity 24 but allows a space 25 to be defined therebetween which facilitates the brazing or bonding of cutter 16 within cavity 24.

Figure 3:
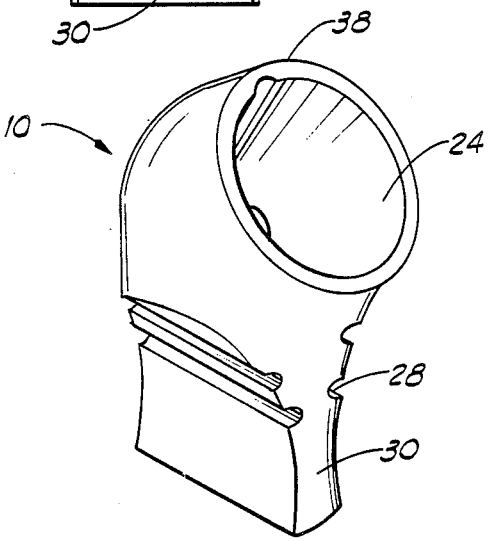
FIG. 3 is a perspective view of the metal receptacle shown in FIG. 1 and 2.

The detailed aspects of the shapes of receptacle 10 are better illustrated in the perspective view of FIG. 3 wherein receptacle 10 is shown in isolation of bit 12 and cutter 16, clearly depicting a longitudinal groove 38 defined within cavity 24.

Figure 4:
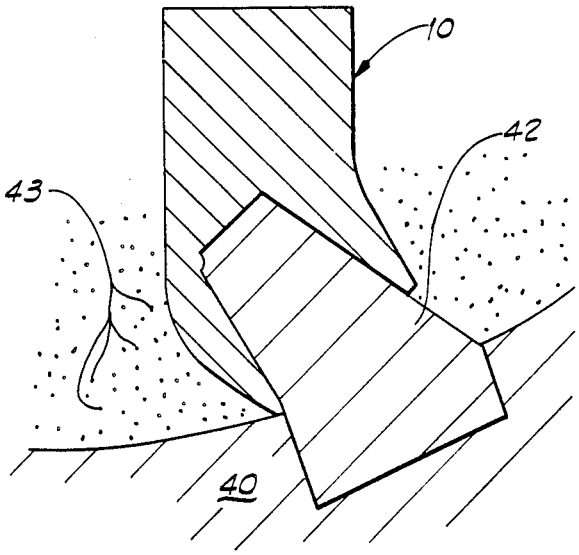
FIG. 4 is a side cross-sectional view of the metal receptacle of FIG. 1 shown in combination with an insert as utilized during the manufacturing process.

Turn now to FIG. 4 wherein the fabrication of the invention is described. Metal receptacle 10 is placed in a conventional manner within a graphite mold 40 shown in fragmentary cross-sectional view in FIG. 4. A pressed graphite insert 42 which may also be appropriately made of ceramic, dental plaster or other filler material, is disposed into cavity 24 on the one hand and appropriately placed on or in mold 40 on the other. Mold 40 is then filled with matrix powder 43 in a conventional manner and furnaced. The shape of insert 42 is appropriately machined or formed not only to prevent matrix powder from entering cavity 24, but to accommodate and define the outwardly extending envelope of replaceable cutter 16 with respect to adjacent metal matrix portions of the bit face. Thus it can be readily understood that a large variety of cutter shapes can be accommodated without redesign of ductile metal receptacle 10.

Figure 5:
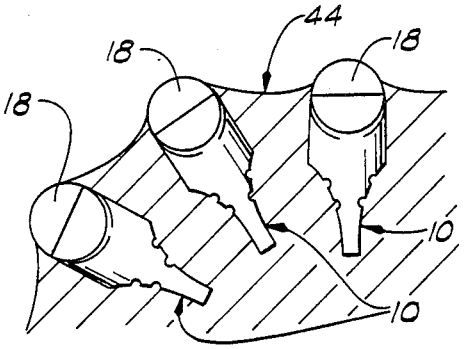
FIG. 5 is a cross-sectional front view of a plurality of cutters as described in connection with FIGS. 1–4 as would appear on the crown of the bit.
Figure 7:
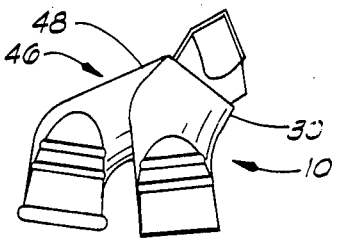
FIG. 7 is a side elevational view of the cutter shown in FIG. 6.
Figure 8:
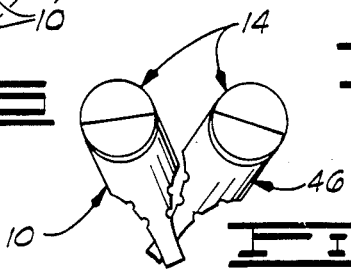

The structure and manufacture of a single cutter and receptacle combination now having been described and illustrated, consider the combination of such cutters and receptacles in an assembly as shown in FIGS. 5–7. FIG. 5 illustrates three such cutters shown in front cross-sectional view on the crown of a bit 12. The tapered shape of the lower portion of metal receptacle 10 allows their compact grouping on crown 44 without interference or contact between adjacent receptacles. This clearly allows not only high density of cutters, but also placement on highly curved bit portions.

An alternative embodiment of the invention is illustrated in front elevational view in FIG. 6 and in side elevational view in FIG. 7. FIGS. 6 and 7 illustrate a combination of two receptacles 10 and 46 in a side-by-side interlocking or at least interleaved relative position. Receptacle 10 has a shape as described in connection with FIGS. 1–4 while receptacle 46 is shaped with an alternative geometry which allows its linking with receptacle 10. In the illustrated embodiment, receptacle 46 has a bent or slanted lower portion 48 which allows the root of receptacle 46 to be placed immediately behind root 30 of receptacle 10 without interference while allowing the cutters of each of the receptacles to lie on a common radius of the bit face. Thus, FIGS. 6 and 7 illustrate that it is entirely included within the scope of the invention that alternative and/or complementary geometries of the receptacles could be employed to acquire even greater cutter densities and placements at even greater bit face curvatures than possible with the design and arrangement shown in Figure 5.

Many alterations and modifications may be made by those having ordinary skill in the art without departing from the spirit and scope of the invention. For example, receptacles capable of accomodating a plurality of cutters may be employed, or a receptacle utilizing a plurality of roots might be utilized to receive and retain a large diamond compact cutter of the type recently developed for use in bits. Therefore, it is expressly understood that the illustrated preferred embodiments have been set forth only for the purposes of example and should not be taken as limiting the invention which is defined in the following claims.

We claim:

1. An improved matrix drag bit comprising:

a body defining a curved bit face thereon;

at least one ductile metal receptacle substantially disposed within said body and adapted to receive a replaceable cutter element, said receptacle including a first, leading end defining a receiving cavity and a second, trailing end extending from said first end at an angle thereto deeper into said body and comprising a progressively laterally narrowing, tapered root having first mechanical locking means associated therewith for permanently securing said receptacle within said body, the length of the tapered root in cross section measured from the front to the back of the tapered root being greater than the thickness of the tapered root in cross section measured from side to side of the tapered root at least for a major portion thereof;

a replaceable cutter element comprising a cutting surface supported on a body portion disposed at least in part within said receiving cavity, whereby said cutting surface extends above said curved bit face, said body portion being temporarily secured within said receiving cavity by second mechanical locking means adjacent thereto adapted to prevent rotational movement of said cutting element within said receiving cavity.

2. The apparatus of claim 1, wherein said first locking means includes at least one transversely extending groove on said tapered root.

3. The apparatus of claim 1, wherein said first locking means includes a laterally flared portion on said tapered root.

4. The apparatus of claim 1, wherein said receiving cavity is of a tapered configuration extending from a larger mouth to a smaller bottom, and said body portion of said cutter element is of a like, substantially mating configuration.

5. The apparatus of claim 1, further comprising a plurality of cutter elements extending above said curved bit face from closely laterally coadjacent receptacles disposed in said body, wherein said second end tapered roots thereof are oriented at acute angles toward each other to facilitate said close coadjacent disposition on said curved bit face.

6. The apparatus of claim 5, wherein said first mechanical locking means includes at least one transversely extending groove on each of said tapered roots.

7. The apparatus of claim 5, wherein said first locking means includes a laterally flared portion on each of said tapered roots.

8. The apparatus of claim 5, wherein the receiving cavity of each of said receptacles is of a tapered configuration extending from a larger mouth to a smaller bottom, and said body portions of said cutting elements are of like, substantially mating configurations.

9. The apparatus of claim 1, further comprising a plurality of substantially laterally aligned cutter elements extending above said curved bit face from closely laterally coadjacent receptacles disposed in said bit body, one of said receptacles including a first end of greater longitudinal extent than that of the other of said receptacles, and said second end tapered roots of said receptacles being oriented at a mutually acute angle in overlapping configuration to facilitate said cutter element alignment in close coadjacent disposition on said curved bit face.

10. The apparatus of claim 9, wherein said first locking means includes at least one transversely extending groove on each of said tapered roots.

11. The apparatus of claim 9, wherein said first locking means includes a laterally flared portion on each of said tapered roots.

12. The apparatus of claim 9, wherein the receiving cavity of each of said receptacles is of a tapered configuration extending from a larger mouth to a smaller bottom, and said body portions of said cutting elements are of like, substantially mating configurations.

* * * * *